United States Patent [19]

Focke

[11] Patent Number: 4,790,115

[45] Date of Patent: Dec. 13, 1988

[54] TURRET FOR PACKAGING MACHINES

[75] Inventor: Heinz Focke, Verden, Fed. Rep. of Germany

[73] Assignee: Focke & Co (GmbH & Co.), Verden, Fed. Rep. of Germany

[21] Appl. No.: 82,611

[22] Filed: Aug. 7, 1987

[30] Foreign Application Priority Data

Aug. 16, 1986 [DE] Fed. Rep. of Germany ..... 3627912

[51] Int. Cl.[4] ..... B65B 11/28

[52] U.S. Cl. ..... 53/234; 198/423.1; 198/803.7

[58] Field of Search ..... 53/579, 234; 198/803.7, 198/473.1

[56] References Cited

U.S. PATENT DOCUMENTS

| | | | |
|---|---|---|---|
| 1,309,935 | 7/1919 | Calleson | 198/473.1 X |
| 1,758,929 | 5/1930 | Burns | 198/473.1 X |
| 2,324,312 | 7/1943 | Meyer | 198/473.1 X |
| 3,396,506 | 8/1968 | Geyer | 53/234 |
| 3,957,154 | 5/1976 | Shiba | 198/473.1 X |
| 4,581,004 | 4/1986 | Nagata | 53/234 |

*Primary Examiner*—John Sipos

*Attorney, Agent, or Firm*—Sughrue, Mion, Zinn, Macpeak and Seas

[57] ABSTRACT

A folding turret (10) for receiving packs (11) or other articles in pockets (17) consists of part turrets (25, 26) which are adjustable relative to one another during a stationary phase of the turret, in such a way that the cross-section of the pockets (17) is temporarily increased and then reduced again. During the rotary movement of the folding turret, the pockets (17) have a reduced cross-section which ensures that the packs (11) are fixed within the pockets (17) as a result of a clamping effect.

12 Claims, 4 Drawing Sheets

TURRET FOR PACKAGING MACHINES

DESCRIPTION

The invention relates to a turret with pockets arranged along the periphery and intended for receiving articles, especially packs, the pockets being limited by at least two (parallel) side walls.

Turrets are rotary-driven members for transporting packs or pack contents in conjunction with packaging machines. The outer periphery of a turret is equipped with pockets which respectively receive the pack contents or the packs which may already be partially finished. During the transport of the articles (together with the packaging blank) or of the packs, manipulations are carried out on these, especially folding operations and the welding or bonding of blanks.

When high-performance packaging machines are used, high rotational speeds of the folding turrets are necessary if short cycle times are to be achieved. Above all where folding turrets rotating in steps are concerned, there are necessarily high rotational speeds, because the stationary phase for carrying out the requisite measures on the packs should be as long as possible, but the phase of rotary movement should be as short as possible. The high rotational speeds can lead to undesirable shifts of the packs in the pockets. This applies particularly to turrets, in which the pockets are open on the radially outer side, so that the articles and packs can be pushed into the pockets and out of them as a result of radial movement. Since the dimensions of the pockets, in particular the distances between the side walls limiting them, are set to the dimensions of the packs or of the pack contents, the centrifugal forces can lead to undesirable relative shifts within the pockets. This occurs, above all, when the pack contents, for example a single article, is received in the pack with considerable play.

The object on which the invention is based is to design and develop further a (folding) turret of the type described in the introduction, so that, even at high rotational speeds, shifts of packs and other articles within the pockets of the turret are prevented.

To achieve this object, the turret according to the invention is characterized in that the side walls of the pockets are movable relative to one another in order to increase or reduce the cross-section for the article or the pack.

The movability of the pocket side walls which define the inner space or the internal dimensions of the pocket, makes it possible to guarantee a larger cross-section of the pockets for specific work phases, in particular for pushing in and pushing out the articles and packs, but during other phases, especially during the rotation of the folding turret, hold the pack contents with a clamping effect as a result of an appropriate reduction in the cross-section of the pockets.

According to a preferred embodiment of the invention, the turret consists of (two) part turrets which are each movable independently together with one of the side walls of a pocket. The part turrets are rotatable about a common axis. A regulating gear can be controlled in such a way that, during the stationary phases, the part turrets, and consequently the side walls of the pockets, execute a short relative stroke in relation to one another, so that the cross-section of the pockets is widened or narrowed slightly. In the position in which the cross-section of the pockets is enlarged, the articles or packs can be introduced into or pushed out of these.

During the rotary movement of the turret, the cross-section of the pockets is narrowed so that their contents are fixed with a clamping effect. This prevents the possibility that the articles or packs will be shifted as a result of centrifugal forces in the pockets open on the radially outer side.

Further features of the invention relate to the design of the part turrets and of the pockets and to the gear for the relative adjustment of the part turrets in relation to one another.

An exemplary embodiment of the invention is explained in detail below with reference to the drawings. In these:

Figure 1:
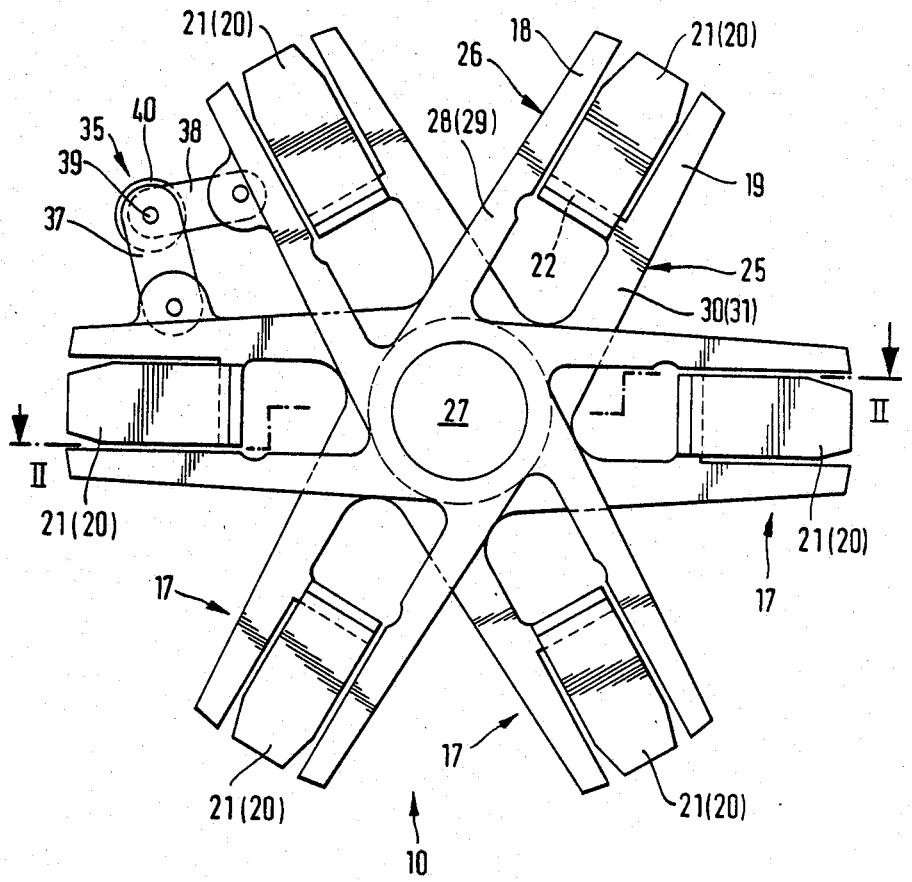
FIG. 1 shows a side view of a folding turret in a simplified representation.
Figure 2:
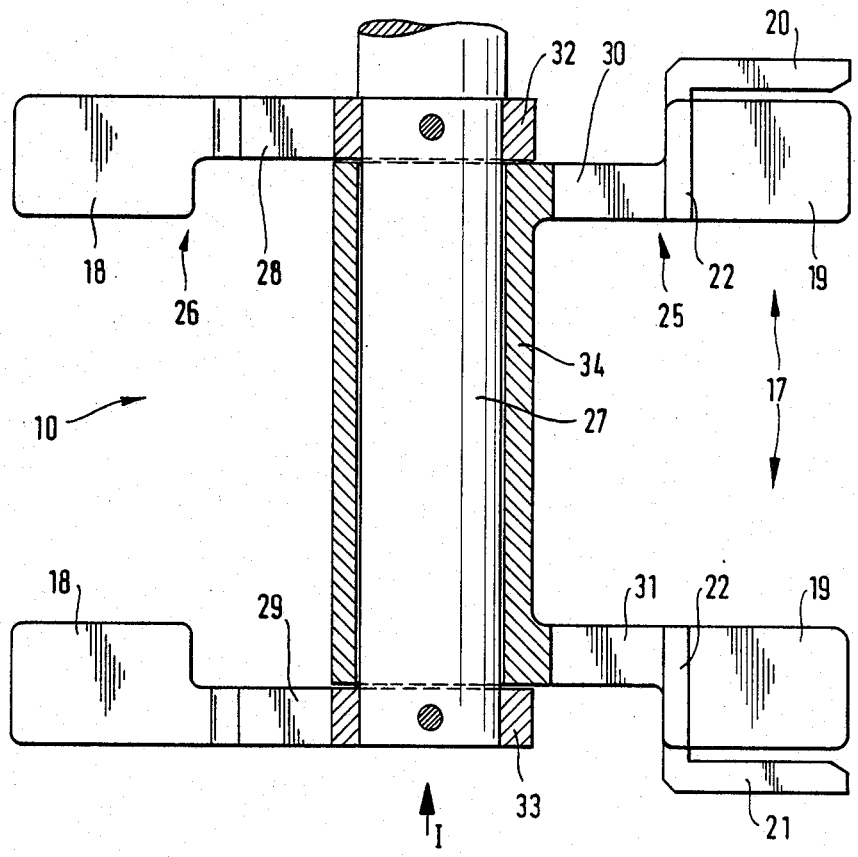
FIG. 2 shows a horizontal section along the sectional plane II—II of FIG. 1.

The turret 10 illustrated is used in conjunction with or as part of a packaging machine. In the present case, as an example, the operation involves wrapping elongate packs 11 in an outer wrapper 12 made of transparent film or plastic. The pack 11 made of (thin) cardboard has been produced and filled in the region of other units of the packaging machine. In this example, the contents of the pack 11 is a single solid article, namely a tube 13. This is received with play in the pack 11 of rectangular cross-section, so that the tube 13 can execute relative movements within the pack 11.

In the region of the turret 10, tubular tabs 14 and 15 of the outer wrapper 12 are folded round in succession against the associated side face 16 of the pack 11 pointing radially outwards and are finally joined to one another by sealing. Furthermore, end folds can be made by folding members which are not shown in the drawings.

The turret 10 has several pockets 17, six in the present case. These are limited in the peripheral direction of the turret 10 by side walls 18 and 19. The radially outer side of the pockets is open, so that as a result of a radial shift the packs 11 can each be introduced into a (horizontally directed) pocket 17 and pushed out of this. The pockets 17 are also limited by end walls 20 and 21 acting in the axial direction. The radially inner closure of the pockets 17 is formed by a bottom wall 22.

At least the side walls 18 and 19 are movable relative to one another, specifically for the purpose of widening or narrowing the free cross-section of the pockets 17. With the side walls 18, 19 moved away from one another, the packs 11 can be introduced faultlessly into a horizontally directed pocket 17 in the region of a pushing-in station 23, specifically together with the outer wrapper 12 which wraps round the pack 11 in a U-shaped manner. On the opposite side, the packs 11, finished where the outer wrapper 12 is concerned, are pushed out of a likewise horizontally directed pocket 17 again in the radial direction in the region of a pushing-out station 24. In the example shown, the intermittent movement of the turret 10 takes place in the anti-clockwise direction, so that the (two) pockets 17 filled with packs 11 are directed upwards in the region between the pushing-in station 23 and pushing-out station 24. Consequently, a widening of the cross-section of the pockets 17 by moving the side walls 18, 19 away from one another does not result in the possibility that the packs 11 will slide out of the upward-directed pockets 17.

To make the abovementioned changes to the pockets 17, the turret 10 consists of several, here of two part turrets 25 and 26. Each of the side walls 18 and 19 is assigned to one of these. Thus, when the part turrets 25, 26 are adjusted relative to one another, the side walls 18, 19, as part of one part turret or the other 25, 26, are also adjusted at the same time. The part turrets 25 and 26 together form the turret 10 and are rotatable as a single unit.

The part turrets 25 and 26 are rotatable about a common axis. In the present case, the part turret 26 is connected fixedly to a drive shaft or a shaft journal 27. In contrast, the part turret 25 is mounted rotatably on the shaft journal 27.

In the present case, the part turrets 25 and 26 each consist of approximately radially directed turret arms 28, 29 and 30, 31. The side walls 18 and 19 are arranged at the ends of these arms 28, 29 and 30, 31, but not continuously over the entire length of the turret 10, but only as short or narrow legs. Accordingly, the packs 11 are surrounded within a pocket 17 by side walls 18, 19 and the bottom wall 22 not over their entire length, but only at the ends of the elongate packs 11. Each pocket 17 therefore consists of two end pockets for receiving the end regions of the pack 11. This is free in the middle region between the arms 28, 29 and 30, 31. In the region of the turret arms 30 and 31, the dimensions of the bottom wall 22 in the axial direction are also the same as those of the side walls 19 arranged on the same turret arms 30, 31.

The turret arms 28 and 29 assigned to the side walls 18 of a pocket 17 are each fastened to a collar 32, 33 on the shaft journal 27 or to the end of the latter at an axial distance from one another. The part turret 25 is mounted between the collars 32, 33 on the shaft journal 27, specifically by means of a continuous rotary sleeve 34.

The part turrets 25, 26 are adjustable relative to one another over an angle 36 by means of a regulating gear 35. The regulating gear 35 consists of a toggle-lever arrangement with the plates 37 and 38. These are respectively connected in an articulated manner or pivotably to the sides of adjacent turret arms 28 on the one hand and 30 on the other hand. The two plates 37 and 38 are brought together in a common joint 39. A tracer roller 40 is mounted in this. The regulating gear 35 consisting of the plates 37 and 38 is stressed in the direction of a moving together of the side walls 18 and 19 of the pockets 17, that is to say in the direction of a reduction in the pocket cross-section. For this purpose, a tension spring 41 engages on the toggle joint, in particular in the common joint 39, and at the other end is anchored to the turret 10.

The tension spring 41 is active only during the rotary movement of the turret 10. This means that a force which reduces the cross-section of the pocket 17 is exerted on the part turrets 25, 26. During this phase, the packs 11 are held in the pockets under a clamping effect.

When the turret 10 is stationary, there is a relative movement of the part turrets 25, 26 in relation to one another so as to move the side walls 18, 19 away from one another. For this purpose, the toggle joint is stressed counter to the force of the tension spring 41 so as to reduce the angular setting between the plates 37 and 38. A regulating member acts on the tracer roller 40 of the plates 37 and 38 for the purpose of executing a movement directed radially outwards. In the exemplary embodiment illustrated, the adjustment is made by means of a cam disc 42 or 43. In the embodiment according to FIG. 3, during the adjustment of the plates 37, 38 the tracer roller 40 runs on the outer periphery of the cam disc 42. This is equipped, in the region between each of the pockets 17 of the turret 10, with a cam projection 44 which stresses the tracer roller 40 and which consequently pivots the plates 37, 38, in such a way that the adjacent turret arms 28 and 30 are moved towards one another. In the alternative design of the cam disc 43 according to FIG. 4, there is a similarly shaped cam groove 45, in which the tracer roller 40 runs during the adjusting movement.

The cam discs 42, 43 are arranged concentrically relative to the turret 10, so that, during the (intermittent) rotary movement of the turret 10, the tracer roller 40 can run outside the cam projections 44 on the cam disc 42 or in the cam groove 45 of the cam disc 43. For this purpose, the cam disc 42 or 43 is mounted rotatably by means of a guide sleeve 46 on a stationary hollow journal 47. This in turn is mounted on a supporting element of the packaging machine, on a gear casing 48 in the exemplary embodiment of FIG. 4. The shaft journal 27, the drive of which is located in the gear casing 48, passes through the hollow journal 47. The cam disc 42 or 43 executes a rotary movement over the angle 36 only during the stationary phase of the turret 10, in particular in order to adjust the turret arms 28 to 31 relative to one another. This to-and-fro rotary movement is generated by a connecting rod 49 which is connected in an articulated manner to the cam disc 42 or 43. The connecting rod 49 is driven in a suitable way, for example by means of a pressure-medium cylinder (not shown).

Figure 3:
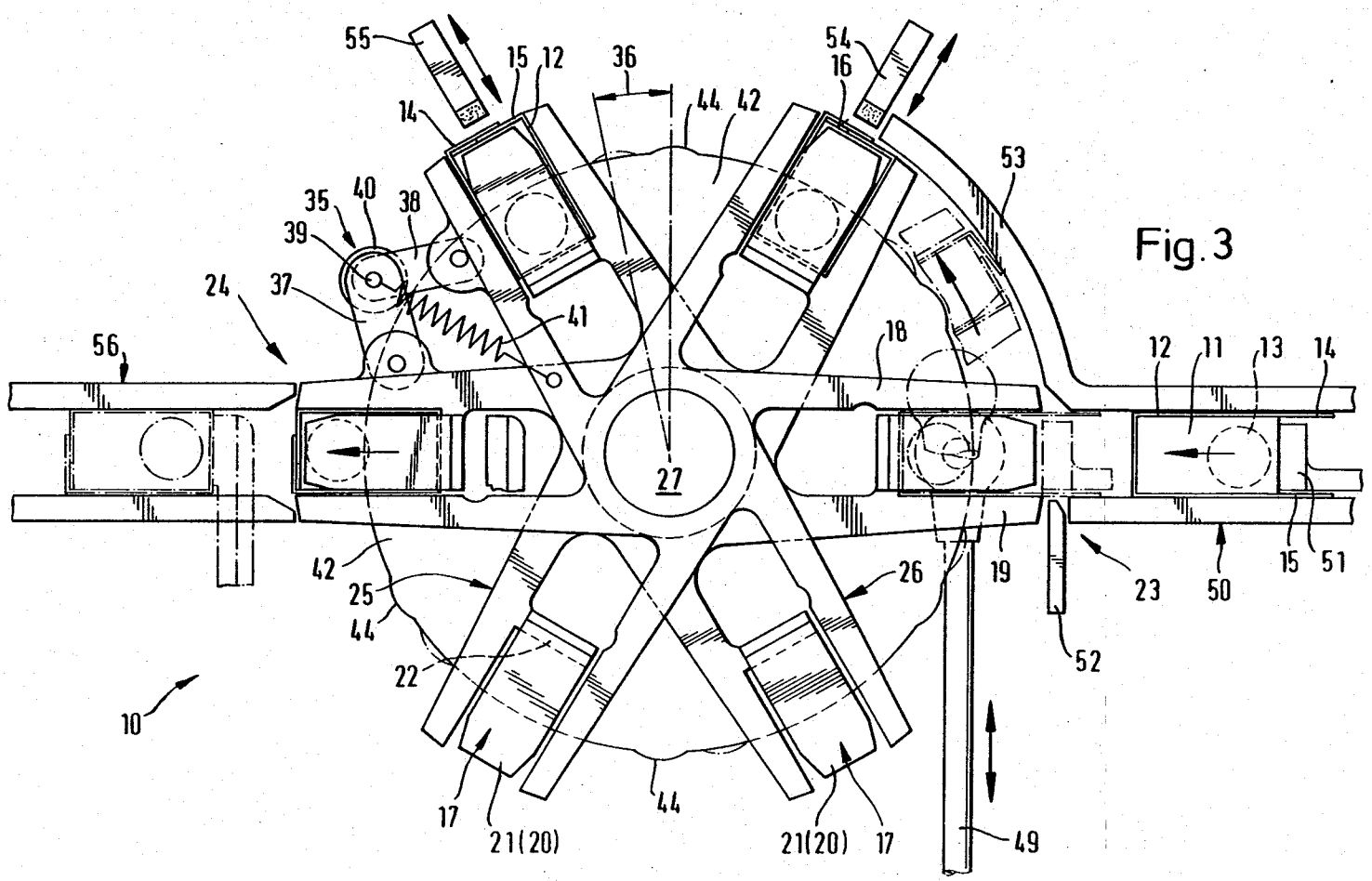
FIG. 3 shows a side view of the folding turret according to FIG. 1 on a reduced scale, with a regulating gear for part turrets.
Figure 4:
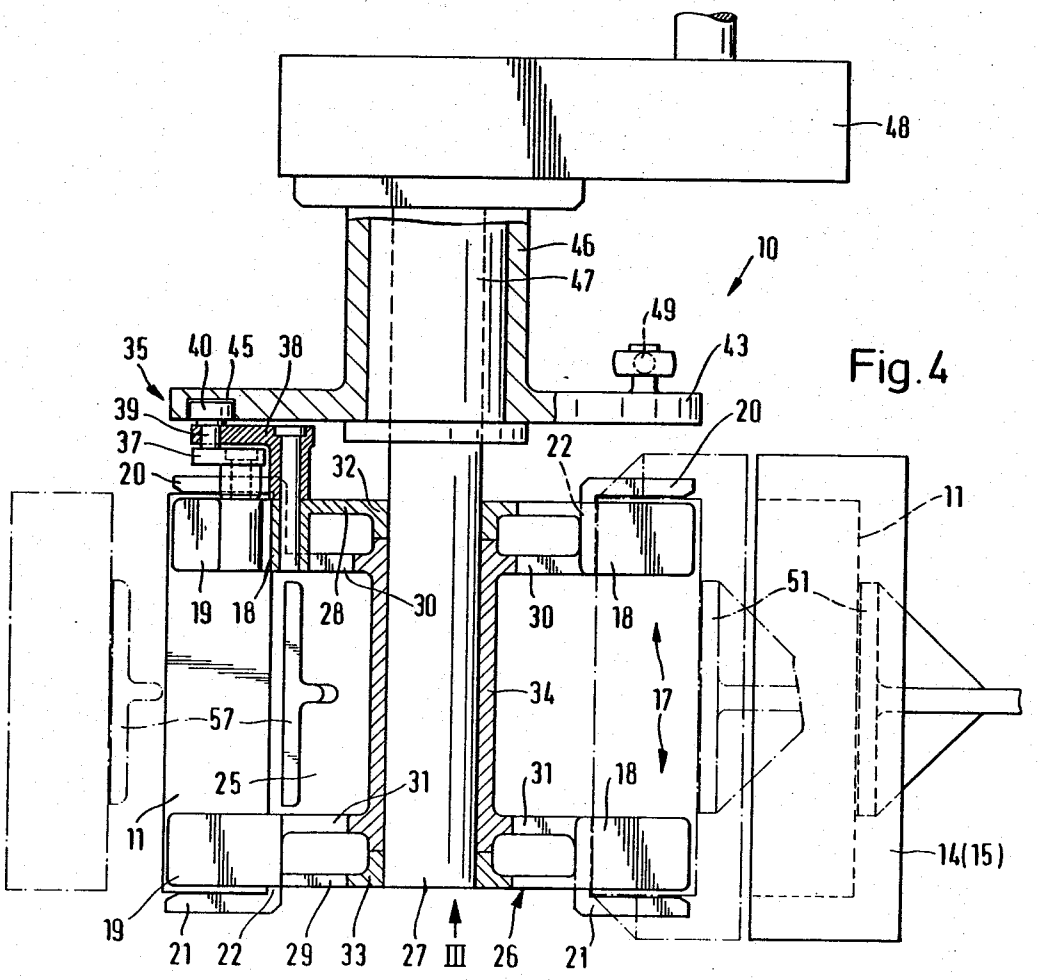
FIG. 4 shows a horizontal section through the folding turret according to FIG. 3.

In the practical example illustrated in Figures 3 and 4, the packs 11 are introduced, via a horizontal pack conveyor belt 50, into the pocket 17, together with the outer wrapper 12, which faces the latter. After a slide 51 has moved back, the tubular tab 15 at the bottom or at the rear in the direction of rotation is folded round against the outer side face 16 of the pack 11 by a folding finger 52. During the subsequent further movement of the turret 10, the upper or front tubular tab 14 is likewise folded round against the side face 16, specifically by means of a fixed curved guide wall 53 extending along a part circle outside the range of movement of the turret 10.

During the next stationary phase, the tubular tabs 14, 15 overlapping one another are sealed or presealed by a first sealing member 54. During the next stationary phase, further sealing (final sealing) of the tubular tabs 14, 15 is carried out by a further second sealing member 55. During the subsequent stationary phase, the finished pack 11 is pushed out of the horizontal pocket 17 onto a discharge conveyor belt 56 likewise directed horizontally. A pushing-out device 57 arranged so as to be movable to-and-fro between the turret arms 28 to 31 is activated for this purpose.

Because the turret 10 is designed in a way described, it can execute relatively rapid rotary movements or indexing strokes. This in turn allows longer stationary phases for pushing the packs in and out. Preferably, the movement phase of the folding turret amounts to 120° of a work cycle. The entire stationary phase amounts to 240°. At the same time, the stationary phase is appropriately divided into two part phases of 120° each. During a first stationary phase of 120°, the tubular tabs 14 and 15 are sealed by the sealing members 54 and 55. During this first stationary phase, the side walls 18, 19 of the pockets 17 remain in the closing or clamping position, that is to say in the narrow position. During a further stationary part phase of 120°, the side walls 18, 19 are moved away from one another, that is to say the pockets 17 are opened. The packs 11 can now be pushed in and out.

I claim:

1. An intermittently rotatable turret for transporting cuboid packs and mounted on a rotatable axis comprising:

a plurality of pockets arranged along the turret's periphery for receiving respective packs (11), each pocket (17) being defined by at least two parallel side walls (18, 19) extending generally radially from said axis;

two separate and independent per turrets mounted on said axis and each carrying one of said side walls, each side wall having an axially extending portion such that the respective portions engage opposed sides of said packs in the same plane perpendicular to said axis and without any axial displacement between said portions;

regulating means for independently rotating said part turrets relative to one another during operation of the turrets to move (35) said side walls (18, 19) toward or away from one another in the peripheral direction of the turret in order to increase or reduce the cross-section of each pocket;

means for radially inserting packs into, said radially pushing packs out of, said pockets when the side walls are moved away from one another.

2. Turret according to claim 1, characterized in that each part turret (25, 26) has several turret arms (28, 29; 30, 31) which extend outwards from a central common pivot axle (27) and to which the side walls (18, 19) are attached on the outside, in such a way that at least two turret arms (28, 29, or 30, 31) of either of two part turrets (25, 26), together with the associated side walls (18, 19), limit a pocket (17).

3. Turret according to claim 1, characterized in that arranged on one of the part turrets (25) in the region of the associated side wall (19) is an end wall (20, 21) directed transversely to the latter and belonging to the pocket (17).

4. Turret according to claim 1, characterized in that, on at least one of the part turrets (25), a bottom wall (22) of the pocket (17) is arranged in the region of the side wall (19), on the radially inner side of the latter.

5. Turret according to claim 1, characterized in that each part turret (25, 26) has, for each pocket (17), two turret arms (28, 29; 30, 31) arranged at an axial distance from one another, and in that the walls for forming the pockets (17) (side wall 18, 19; end wall 20, 21; bottom wall 22) are formed only in the region of the turret arms (28 to 31), in such a way that each pocket (17) consists of two lateral part pockets complementing one another.

6. Turret according to claim 1, characterized in that one of the part turrets (26) is attached fixedly to a drive shaft (27), and the other part turret (25) is mounted, rotatably on the drive shaft (27), between the turret arms (28, 29) of the part turret (26) mounted fixedly on the drive shaft (27).

7. Turret according to claim 6, characterized in that the turret arms (30, 31) of the part turret (25) which are arranged at an axial distance from one another are connected to a common rotary sleeve (24) which is mounted rotatably on the drive shaft (27) between the turret arms (28, 29) of the part turret (26).

8. Turret according to claim 1, characterized in that, during the rotation of the turret (10), the side walls (18, 19) of the pockets (17) are at a shorter distance from one another, in such a way that a pack (11) is held between the side walls (18, 19) of the pocket (17) by means of a clamping force.

9. Turret according to claim 1, characterized in that, during the stationary phase of the turret (10), during a first phase the side walls (18, 19) are held in a relative position fixing the packs (11) with a clamping effect, for carrying out manipulations on the packs (11), and thereafter, during a further stationary phase, as a result of a relative movement of the part turrets (25, 26) the side walls (18, 19) can be moved away from one another for pushing the packs (11) into and out of the pockets (17).

10. Turret according to claim 1, characterized in that the adjacent part turrets (25, 26) are connected to one another by said regulating gear means (35) having two plates (37, 38) which are connected to one another in an articulated manner and which can be stressed in the spreading direction to move the part turrets (25, 26) in order to narrow the pockets (17).

11. Turret according to claim 10, characterized in that the plates (37, 38) are stressed by a pressure member, in the form of a tension spring (41), so as to spread or so as to reduce the cross-section of the pockets (17), and in that, during a stationary phase, the plates (37, 38) can be stressed counter to the load exerted by the tension spring (41) by means of a counter-pressure member, in the form of a cam disc (42, 43) acting via a tracer roller (40), in order to increase the cross-section of the pockets (17).

12. Turret according to claim 11, characterized in that, during the stationary phase of the turret (10), the cam disc (42, 43) actuates the regulating gear means (35) via the tracer roller (40) as a result of a rotary stroke over an angle (36).

* * * * *